US007134593B2

(12) United States Patent
Harrelson

(10) Patent No.: US 7,134,593 B2
(45) **Date of Patent: *Nov. 14, 2006**

(54) PAPERBOARD CARTON WITH A NEW TYPE OF DISPENSER

(75) Inventor: Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/140,219

(22) Filed: May 27, 2005

(65) Prior Publication Data

US 2005/0205653 A1 Sep. 22, 2005

Related U.S. Application Data

(63) Continuation of application No. 10/371,692, filed on Feb. 22, 2003, now Pat. No. 6,974,072.

(51) Int. Cl.
*B65D 5/54* (2006.01)
*B65D 65/28* (2006.01)

(52) U.S. Cl. ..... 229/122.1; 206/427; 221/305; 229/122; 229/242

(58) Field of Classification Search ..... 229/122, 229/122.1, 240, 241, 242; 206/427; 221/302, 221/305

See application file for complete search history.

(56) References Cited

U.S. PATENT DOCUMENTS 2,005,924 A * 6/1935 Wilson ..... 229/242
2,067,749 A * 1/1937 Zimmerman et al. ..... 221/305
3,263,861 A 8/1966 Carr
3,265,283 A 8/1966 Farquhar
3,300,115 A 1/1967 Schauer
3,332,594 A 7/1967 De Capua
3,346,167 A * 10/1967 Schmidt ..... 206/427
3,356,279 A 12/1967 Root
3,517,858 A 6/1970 Farquhar
3,540,581 A * 11/1970 Koolnis ..... 229/122
4,214,660 A * 7/1980 Hunt, Jr. ..... 206/427
4,364,509 A 12/1982 Holley, Jr. et al.
4,396,143 A 8/1983 Killy
4,417,661 A * 11/1983 Roccaforte ..... 229/925
5,505,372 A * 4/1996 Edson et al. ..... 229/121
5,597,114 A * 1/1997 Kramedjian et al. ..... 229/122.1
5,690,230 A * 11/1997 Griffith ..... 229/242
6,478,219 B1 11/2002 Holley, Jr.
6,866,188 B1 * 3/2005 Harrelson ..... 229/121
6,974,072 B1 * 12/2005 Harrelson ..... 229/122.1

* cited by examiner

*Primary Examiner*—Gary E. Elkins
(74) *Attorney, Agent, or Firm*—Womble Carlyle Sandridge & Rice, PLLC

(57) ABSTRACT

A carton for carrying a plurality of cans in at least three rows having a dispenser flap that is easily removed from the end of the carton to expose a dispenser which has a bottom of a sufficient height from the bottom panel to prevent containers in the bottom row from rolling out, but less than the diameter of a container in the bottom row. The top of the dispenser is at a height from the bottom panel that is equal to diameter of a can contained in the carton plus the distance that is substantially less than the diameter of a can, such height being sufficient to prevent any container in the middle row from automatically rolling out of the dispenser when opened, but allowing a person to grasp and pull out the container in the middle row that is adjacent to the dispenser.

29 Claims, 3 Drawing Sheets

PAPERBOARD CARTON WITH A NEW TYPE OF DISPENSER

CROSS-REFERENCE TO RELATED APPLICATION

This application is a continuation of U.S. patent application Ser. No. 10/371,692, filed Feb. 22, 2003, now U.S. Pat. No. 6,974,072 which is hereby incorporated herein by reference in its entirety.

BACKGROUND OF THE INVENTION

1. Field of the Invention

The present invention relates generally to an enclosed paperboard carton capable of enclosing cylindrical containers, such as cans, which carton has a unique opening and dispensing feature in an end wall that allows the containers, for example cans, to be removed one at a time with other containers in the carton falling into position for removal. When the dispenser is opened when the carton is resting on its bottom panel, the bottom of the dispenser has been placed far enough above the bottom panel to prevent a container resting on its side in the bottom row from automatically rolling out of the carton. The top of the dispenser is constructed at a height from the bottom panel sufficient to prevent a can in the second row from automatically rolling out of the carton. The dispenser opening extends into the side panels of the carton to permit a person to grasp each end of the container as it falls into position and remove it from the carton. A finger aperture is provided in the dispenser flap which is pulled to open the dispenser with the aperture being located in the space in the side panel formed between the arcs of cans in the first and second row in the dispensing end of the carton.

2. Background

Fully enclosed cartons capable of enclosing cans have been used in the past that have a feature for dispensing the cans one at a time. Dispenser sections have been provided at various locations within those cartons depending on the design. Many of these dispensers suffer from the disadvantage that once open, they allow all of the containers to roll out. In addition, it is difficult to carry one of these cartons without the containers falling out once the dispenser has been opened.

Many of these dispensers destroy the overall carton integrity once they have been opened. Many of these dispensing features do not have any means for preventing the first cylindrical container, e.g. cans, falling from the carton once the dispenser has been opened. In other words, the dispenser has no safety feature.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the sidewalls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened. The dispensing flap does not provide a safety feature to prevent a can from rolling out of the carton and falling to the floor. This carton cannot be easily moved from one location to another after the dispenser has been opened without the containers falling out.

U.S. Pat. No. 4,364,509 to Holley, Jr. et al. also discloses a fully enclosed carton with a dispenser in one of the end walls. This dispenser is likewise formed in the end wall by tearing out an end flap and lowering it into proper position. Expansion slits are provided in the sidewall for the user's fingers to grasp the ends of the exiting can. In addition, it is not adapted for carrying cans once the carton has been opened as they are likely to roll out of the dispenser. The results are no safety feature to prevent the cans from rolling out of the dispenser when the carton is resting on a horizontal surface such as a table.

SUMMARY OF THE INVENTION

It is an object of this invention to provide a dispenser that preserves the integrity of the carton after the dispenser has been opened. It is a further object to provide a dispenser that can be used with cylindrical containers, such as cans. It is a still further object of this invention to provide a dispenser for dispensing cylindrical containers, such as cans, in a carton where the containers are stacked on their sides in at least three rows and where the containers do not automatically roll out of the carton when it has been opened, but are easily grasped and removed from the carton. It is still a further object of this invention to provide a dispenser flap which has an aperture in which a person's finger can be easily inserted to remove the flap thus opening the dispenser for the removal of cans. It is still a further object of this invention to provide a carton where the cylindrical container, such as cans are stacked on their sides in three rows with some of the containers on the top and middle row automatically rolling forward when a can is removed from the dispenser. It is a further object to provide a carton with a dispenser where the cans are stacked on their sides and the cans in the carton do not automatically exist the dispenser, but can be easily removed by grasping the ends of the can.

Briefly described, in a preferred form, the objects of this invention are achieved by providing an enclosed carton that has a unique and new dispenser in the exiting end of the carton. This carton has generally rectangular side panels and has a bottom, a top, and a closed end and an exiting end. This carton is foldably constructed from a blank having panels and flaps. The exiting end or ends of the carton permits cylindrical containers to be taken from the carton through the dispenser. This carton is designed to carry three or more rows of cylindrical containers, such as cans, resting on their sides on the bottom panel of the carton.

In a preferred form, this carton has ends that are formed by a top end flap, bottom end flap, and two side end flaps which are held together by glue. A tear line is provided in the two side end flaps above the bottom end flap at a height sufficient to prevent any can in the bottom row from automatically rolling out of the dispenser when it is opened, at least when the carton is on a horizontal plane. The carton has a top tear line in the two side end flaps that is at a sufficient height from the bottom panel to prevent a can in the second row from automatically rolling out when the dispenser is opened at least when the carton is on a horizontal plane.

These top and bottom tear lines extend into a least one of the side panels and turn toward each other and meet each other so that the dispenser can be opened when removing the dispenser flap between the top and bottom tear lines. Preferably the bottom and top tear lines extend into both side panels and turn and meet each other. Preferably there is a finger aperture between these tear lines in at least one of the side panels that permits a person's finger to enter the aperture and remove the dispenser flap that opens the dispenser. Preferably this finger aperture is placed at the intersection of the side panel and end flap so that a person's finger enters the space between a can in the first row and a can in the second row and the dispenser flap. This enables a person to obtain the necessary grip and leverage for the easy removal of the dispenser flap. This aperture can be placed between the bottom and top tear lines in both side panels, preferably at the intersection of a side panel and end flap. Alternatively, this finger aperture can be placed in the dispensing end of the container so that a person's finger enters the space between the can in the bottom row and a can in the second row for easy removal of the dispenser flap.

The bottom tear line in the dispensing end of the carton is located at a height so that the containers in the bottom row do not automatically roll out when the dispenser is opened. This height is relative to the diameter of the containers in the bottom row. The height of this bottom tear line should be between at least 40 to 80% of the diameter of the containers in the bottom row. Preferably the height of the bottom tear line is approximately 60% of the diameter of a can in the bottom row. The location of the top tear line is also related to the diameter of the cans. It is basically located at a height from the bottom panel that is approximately the diameter of a can in the bottom row plus a distance that is approximately between 60 and 90% of the diameter of a can in the second row. Preferably, the height of the top tear line is approximately the diameter of a can in the bottom row plus approximately 80% of the diameter of a can in the second row. Expressed another way the distance between the bottom tear line and top tear line should be between approximately 110% and 130% of the diameter of a can. It is important that this distance should be great enough so that a can in the second row rolls forward enough so its ends can be grasped for easy removal of the can, but not so great that the cans automatically roll out. The precise location of the bottom and top tear lines is dependent upon the caliber and flexibility of the paperboard of which the carton is constructed and other factors. Basically, the precise location of the bottom and top tear lines is within the parameters discussed above is located so that when the tear lines are torn cans do not automatically roll out of the carton, at least when the carton is in a horizontal plane.

It is important that the tear lines that extend into the side panel extend a sufficient distance and height so that a person's fingers can grasp the ends of the can adjacent to the dispenser and remove it easily. Basically, the top and bottom tear lines should extend into each side panel at about the same height from the bottom panel at which they are placed in the end of the carton. These lines need to extend into each side panel a sufficient distance and then turn to meet each other so that when removed it is easy for a person's fingers to grasp the can adjacent to the dispenser.

It should be realized that the dispenser flap does not have to be totally removed from the carton as long as it is removed from one side and the end panel. It is preferable that the dispenser flap be completely removed so that a person's fingers can easily grasp the ends of the can adjacent the dispenser.

This carton can be constructed by gluing, taping, stapling and the like, or by locking. It is preferred that this carton be glued. The dispenser of this invention can be put in one end of the carton or in both ends. These and other objects, features, and advantages of he present invention will become more apparent upon reading the following specification in conjunction with the accompanying drawing figures.

DETAILED DESCRIPTION OF THE PREFERRED EMBODIMENT

Figure 1:
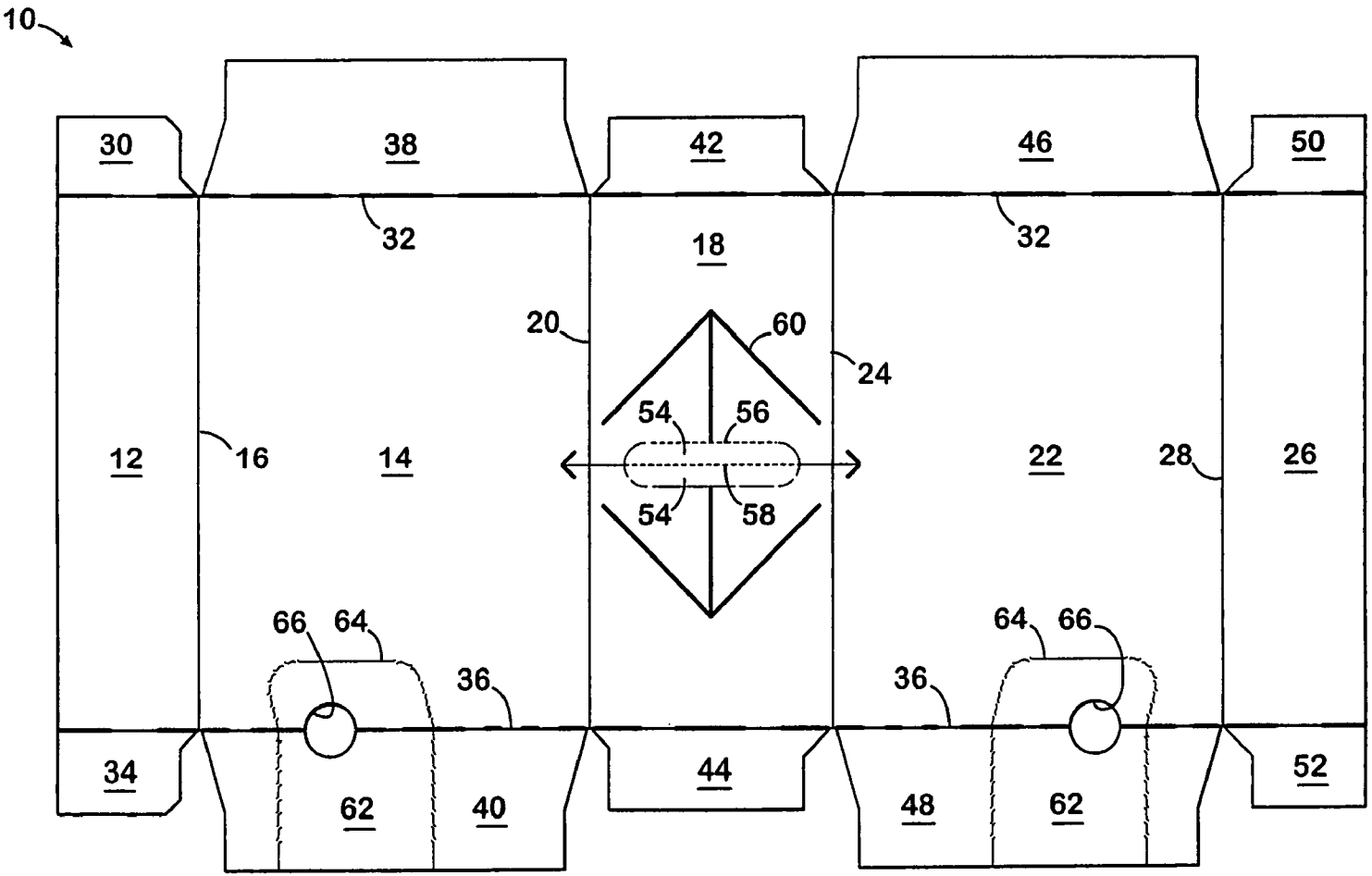
FIG. 1 is a plan view of a blank from which a carton according to one embodiment of this invention is formed.

The present invention is intended primarily for use with cans of the type used to contain soft drinks, beer and the like. The blank 10 is formed from a foldable sheet of material, such as paperboard. The blank has a bottom flap 12 which is connected to side panel 14 by fold line 16. Side panel 14 is connected to top panel 18 by fold line 20 and in turn connected to side panel 22 by fold line 24. Side panel 22 is connected to bottom flap 26 by fold line 28. Bottom end flaps 30 and 34 are connected to bottom flap 12 by fold lines 32 and 36 respectively. Side end flaps 38 and 40 are connected to side panel 14 by fold lines 32 and 36 respectively. Top end flaps 42 and 44 are connected to top panel 18 by fold lines 32 and 36 respectively. Side end flaps 46 and 48 are connected to side panel 22 by fold lines 32 and 36 respectively. Bottom end flaps 50 and 52 are connected to bottom flap 26 by fold lines 32 and 36 respectively. A handle may be constructed in top panel 18 by forming score line 56 for establishing handle flaps 54. A slit 58 may be formed between the two handle flaps 54 into which a person's fingers may be inserted for carrying the carton. This slit 58 may extend into side panels 14 and 22 to relieve the stress imposed by lifting the carton. Stress relief line 60 may be formed around the handle flaps 54 to relieve the stress on the handle when the carton is lifted.

This carton has a dispenser flap 62 formed by providing tear line 64 which extends into side panel 14 and 22 and side end flaps 40 and 48. A finger aperture 66 may be provided for the easy removal of the dispenser flap 62.

This finger aperture 66 should be located in such a position so that a person's finger may be inserted into the finger aperture in the space formed between the two arcs of a can in the bottom row and a can in the next row which are in contact with the dispenser flap 62. This allows a person's finger to be inserted far enough into the carton to provide the necessary leverage for removing the dispenser flap 62. Preferably a finger flap 66 is placed on each side of the dispenser flap 62 to provide the necessary leverage for the removal of the flap. It is preferred that the finger aperture be centered on fold line 36 which is the ideal location for the insertion of a person's finger into the spare between the cans in the bottom row and second row and the dispenser flap 62.

The carton of this invention is easily formed and loaded with cans in the conventional fashion. The bottom flaps 12 and 26 are first folded and glued forming a sleeve into which the cans are loaded with sides of the cans resting on the bottom panel. Using the end of the carton where the dispenser flap 62 is located, top end flap 44 is folded down and bottom end flaps 34 and 52 are folded up and side end flaps 40 and 48 are folded over the end and glued to top end flap 44 and bottom end flaps 34 and 52. The other end of the carton is closed in the same way.

A carton erected from the blank shown in FIG. 1 only has a dispenser flap 62 on one end of the carton. However, a dispenser flap could be placed on both ends of the carton.

Figure 2:
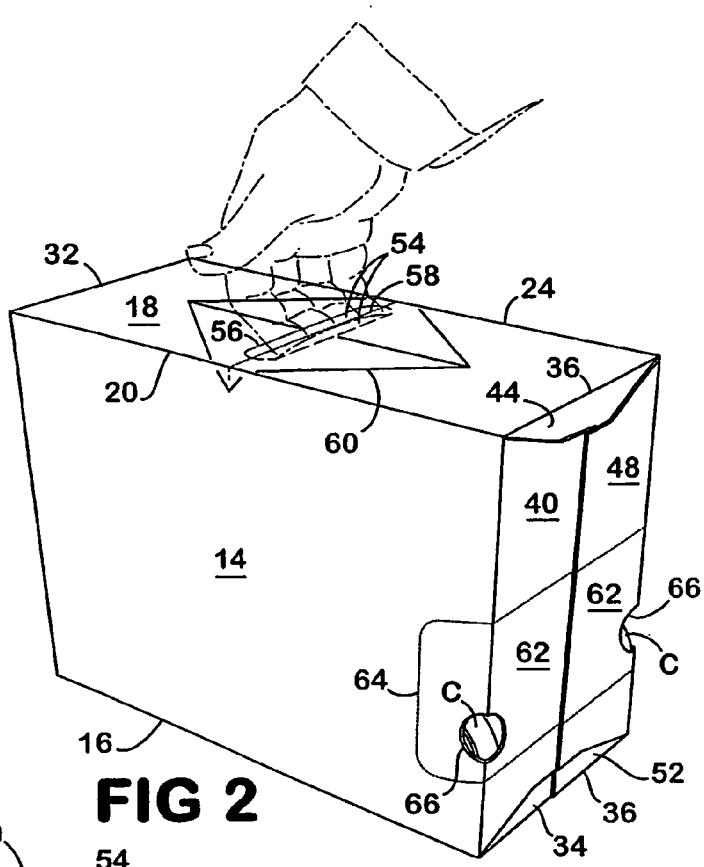
FIG. 2 is a perspective end view of the carton loaded with cans showing a person's hand being inserted into the handle aperture for lifting the carton.

The dispenser of the carton made from the blank of FIG. 1 needs to have the top and bottom tear line 64 placed in the end of the carton in such a way so that none of the cans will roll out when the dispenser flap is opened exposing the dispenser, at least when the carton is in a horizontal plane. The carton illustrated in FIG. 2 is designed to carry 12 cans in a 3 by 4 configuration. It should be realized that a carton can be designed to carry more than three rows and more than four cans in each row. The portion of the tear line near the bottom of the container needs to be a sufficient distance from the bottom panel so that a can C in the bottom row does not roll out of the carton when the dispenser flap 62 is opened. The top portion of tear line 64 needs to be located from the bottom panel at a distance equal to the diameter of the can in the bottom row plus a distance that is substantially less than the diameter of the container in the middle row but sufficient to prevent any container in the middle row from automatically rolling out of the dispenser when the carton is on a horizontal plane. It has been found that the bottom tear line needs to be at a height that is between approximately 40% to 80% of the diameter of a container, as measured from the bottom panel. Preferably the height of the bottom tear line 64 is approximately 60% of the diameter of a can contained in the bottom row, as measured from the bottom panel.

The top tear line 64 should be located from the bottom panel a distance equal to the diameter of the container in the bottom row plus approximately between 60 and 90% of the diameter of a container in the middle row. Preferably the top tear line is located at a distance equal to the diameter of a can in the bottom row plus approximately 80% of the diameter of a can in the second row, as measured from the bottom.

It is preferred that the ends of the carton be constructed of flaps that can be glued together to form the end panel. While in the carton of this embodiment as described in FIG. 1 the end flaps can be closed and glued to form the exiting end, it should be realized that the dispenser can be utilized in a carton in which an end panel is constructed from the same carton blank but the folding and gluing or securing that is necessary is done elsewhere on the blank.

A fully loaded carton with cans resting on their sides on the bottom panel is illustrated in FIG. 2 showing a person's hand inserted into the handle for carrying.

Figure 3:
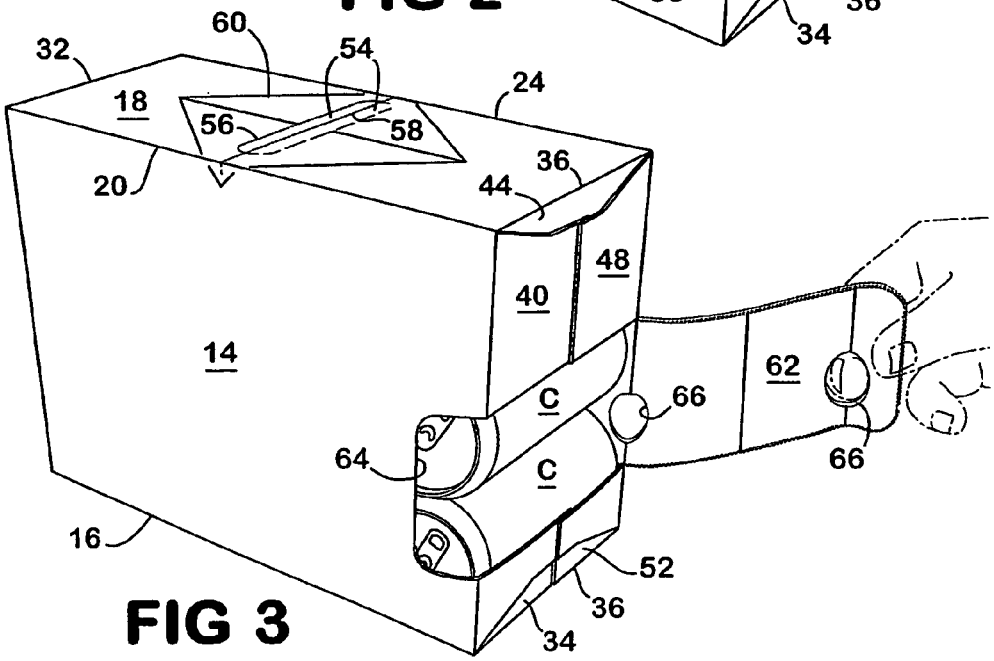
FIG. 3 is a perspective end view of the carton containing cans in which a person's finger has been inserted into the finger aperture in a side panel partially pulling the dispenser flap away from the carton except in one side panel.

Opening the dispenser is illustrated in FIG. 3 where a person's finger has been inserted through finger aperture 66 and having pulled the dispenser flap 62 partially open exposing the cans C in the bottom two rows. A top row of cans is not shown.

Figure 4:
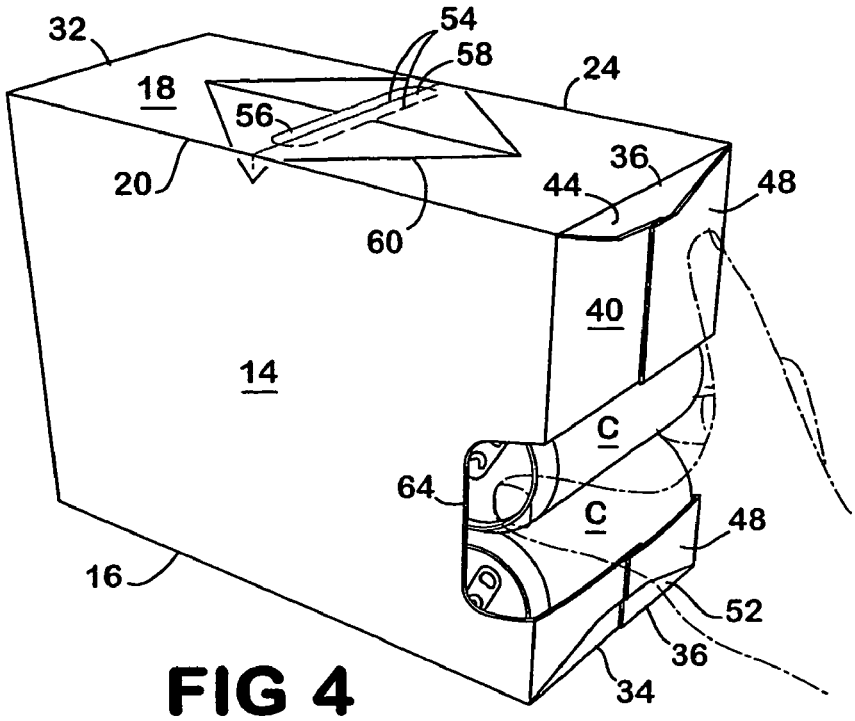
FIG. 4 is a perspective end view of a carton according to an embodiment of this invention in which a person is grasping a can to pull it out of the dispenser.
Figure 5:
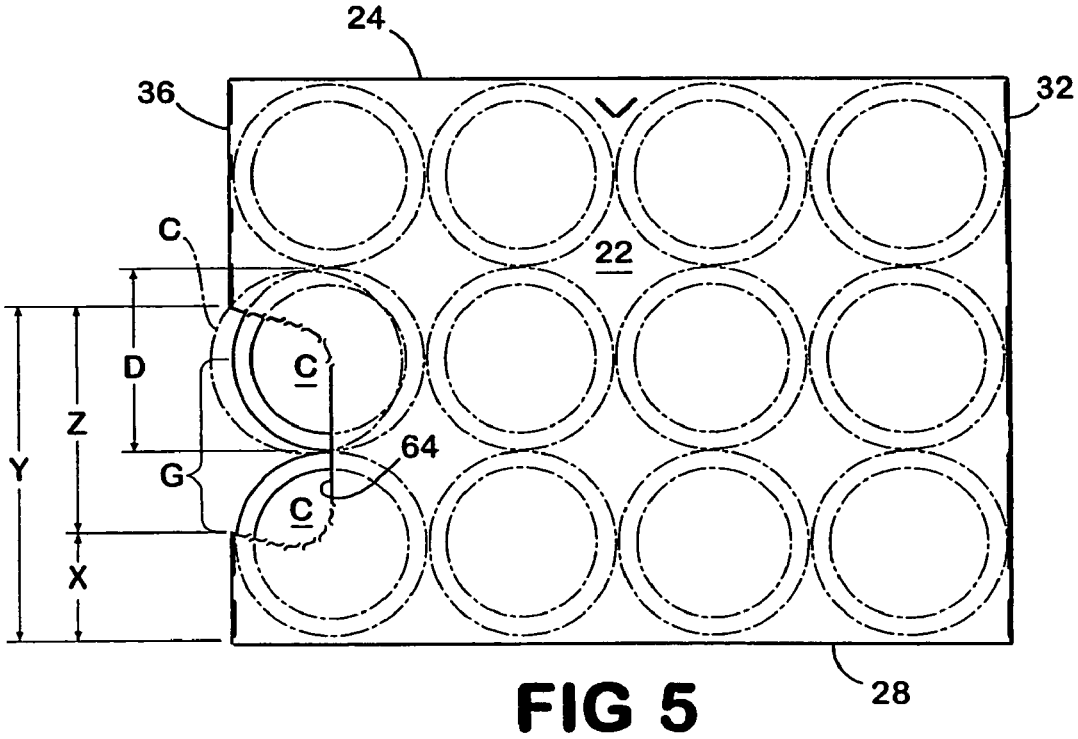
FIG. 5 is a side elevation of a carton with the dispenser open showing a can in the second row having rolled forward slightly through the dispenser opening.

FIG. 4 illustrates a person's finger and thumb grasping the end of a can C for removal of the can. It will be noticed from FIG. 5 that after the dispenser flap is removed the can C in the second row moves slightly forward past the end of the carton shown by fold line 36 to a position as represented by G showing the outside arc of the can. The placing of the bottom and top tear lines 64 is important so that the can C in the second row rolls forward to position G as shown in FIG. 5 so the ends of the can can be grasped for easy removal. The top tear lines can not be placed too high or the cans will automatically roll out of the carton. After this can is removed a can in the top row will drop down for the next removal from the dispenser. Some subsequent cans will roll into position when cans are removed from the dispenser. The carton can be tilted forward so other cans come forward for removal.

As described previously the location of the bottom tear line and the top tear line are at sufficient heights to retain all the cans in the carton when the dispenser is opened but with sufficient distance between them to permit the easy removal of the can. A can can only be easily removed if it can be grasped on both ends as shown in FIG. 5.

As an example of the placement of the top and bottom tear lines 64, FIG. 5 can be used to show the principles. With a can C that has a diameter D of 2.6 inches, the height X of the bottom tear line 64 is preferably placed at approximately 1.6 inches from the bottom of the carton, while the top tear line is placed at a height Y from the bottom panel of approximately 4.65 inches. This results in a dispenser opening of 3.05 inches. The preferred placement of the bottom and top tear lines will depend upon a number of factors, such as the caliber and other characteristics of the paperboard. The bottom tear line needs to be placed at a height so the cans in the bottom row do not roll out, but not so high that a can in the bottom row cannot be grasped and easily removed when the cans in the upper rows have been removed. The top tear line needs to be placed so that it retrains the cans in the upper rows from automatically rolling out of the carton. It also should be placed so that it can be grasped on the ends for easy removal, which means the can in the second row near the dispenser must roll forward slightly as explained above. The placement of tear line 64 in side panel facilitates the grasping of the ends of the cans.

It is preferable that the finger aperture 66 be placed in each side panel near the fold line 36. It is preferable that the finger aperture 66 be centered on fold line 36. The finger aperture 66 can be placed in dispenser flap 62 in side end flap 40 or side end flap 48 so that a person's finger enters the space between a can in the bottom row and a can in the middle row.

Handles other than the handles illustrated in FIG. 1 can be used with a carton of this invention or it can be made with no handle at all. The handle with slits 54 running into the side walls 14 and 22 a short distance as shown in FIG. 1 is the preferred handle for the carton with a dispenser of this invention.

The dispenser of this invention can be used for both cans and other types of cylindrical containers.

UNIQUE FEATURES OF THE DISPENSER OF THIS INVENTION

One of the unique features of the dispenser of this invention is that it provides for easy removal of the dispenser flap giving easy access to the cans, but does not does not diminish the structural integrity of the carton. The dispenser is easy to open because of the placement of the finger aperture. The dispenser is designed so that the bottom tear line when the dispenser is opened retains cans in the bottom row of containers and the top tear line is located at a sufficient height so that it retains cans in the middle row, but also permits easy removal of the can from the middle row which is partially achieved by the placement of the top tear line and partly by the extension of the tear lines into the side panel to permit a person to grasp the ends of a can for removal.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An enclosed carton for a plurality of containers in a plurality of rows, including a first row and a second row above the first row, the carton comprising:

a. a top panel, two side panels, a bottom panel, and two closed ends, at least one of which is an exiting end;

b. top and bottom tear lines that extend across the exiting end and into at least one side panel of the two side panels, the tear lines defining an opening flap that is capable of creating an opening between the tear lines;

c. the bottom tear line being spaced above the bottom panel;

d. when the opening flap is at least partially removed:

(1) the container in the first row adjacent the exiting end and the container in the second row adjacent the exiting end are both prevented from rolling out of the carton, and (2) the container in the second row adjacent the exiting end can be removed from the carton through the opening prior to removal of the container in the first row adjacent the exiting end.

2. The carton of claim 1, wherein the top and bottom tear lines extend into both side panels.

3. The carton of claim 2, wherein a portion of at least one end of the container in the second row adjacent the exiting end is exposed when the opening flap is removed, whereby the portion can be accessed to remove the container in the second row adjacent the exiting end from the carton through the opening.

4. The carton of claim 1, wherein the top and bottom tear lines that extend across the exiting end are substantially parallel.

5. The carton of claim 1, including a handle in the top panel.

6. The carton of claim 1, wherein a means for removing the opening flap is located at least partially in the at least one side panel.

7. The carton of claim 1, wherein each row comprises at least four containers.

8. The carton of claim 1, wherein the containers are cans.

9. A package comprising an enclosed carton and containers arranged in rows, including a first row and a second row above the first row, the carton comprising:

a. a top panel, two side panels, a bottom panel, and two closed ends, one of which is an exiting end;

b. top and bottom tear lines, each extending across the exiting end from one side panel to the other;

c. an opening flap formed at least in part by a portion of the exiting end defined between the top and bottom tear lines; the opening flap being at least partially removable to create an opening;

d. the top and bottom tear lines each being at a sufficient height above the bottom panel to retain all the containers in the package when the opening is created; and e. the top and bottom tear lines being spaced a sufficient distance to permit a container from the second row to be removed through the opening prior to removal of a container from the first row.

10. The package of claim 9, wherein the bottom tear line has a sufficient height above the bottom panel to prevent any containers in the first row from rolling out of the opening when the carton is disposed on a horizontal plane.

11. The package of claim 9, wherein the top tear line has a sufficient height above the bottom panel to prevent any containers in the second row from rolling out of the opening when the carton is disposed on a horizontal plane.

12. The package of claim 9, wherein the top and bottom tear lines extend into at least one side panel and define a first removable portion that is removable with the opening flap.

13. The package of claim 12, wherein removal of the first removable portion exposes at least a part of a first end of a container in the second row.

14. The package of claim 12, wherein a means for removing the opening flap is located at least partially in the at least one side panel.

15. The package of claim 12, wherein the top and bottom tear lines extend into the other side panel and define a second removable portion that is removable with the opening flap.

16. The package of claim 15, wherein removal of the second removable portion exposes at least a part of a second end of a container in the second row.

17. The package of claim 15, wherein a means for removing the opening flap is located at least partially in the other side panel.

18. The package of claim 9, wherein each row comprises at least four containers.

19. The package of claim 9, wherein the containers are cans.

20. The package of claim 9, wherein the top and bottom tear lines that extend across the exiting end are substantially parallel.

21. The package of claim 9, including a handle in the top panel.

22. An enclosed carton for carrying a plurality of containers in a plurality of rows, including a first row, and a second row adjacent the first row, with each container having a diameter and two ends, the carton comprising:

a. a bottom panel, top panel and foldably attached adjoining side panels;

b. a plurality of ends, at least one of which is an exiting end capable of permitting the containers to exit the carton one at a time, said exiting end having a bottom tear line and a top tear line extending thereacross for forming an opening, said bottom tear line having a height from said bottom panel that is sufficient to prevent any container in the first row from rolling out of the carton when said opening is created when the carton is on a horizontal plane, said top tear line having a height from said bottom panel that is greater than the diameter of one of the containers to be contained in the first row of containers and a sufficient height from said bottom panel to prevent any container in the second row from rolling out of the carton when the carton is disposed on a horizontal plane;

c. said top and bottom tear lines extending into at least one of said side panels and said top and bottom tear lines being separable to expose each said end of a container in the second row adjacent said exiting end; and d. means for closing any end of the carton that is not the exiting end.

23. The carton of claim 22 including at least one means for creating the opening between said top and bottom tear lines.

24. The carton of claim 22 in which the sufficient distance permits a container in the second row adjacent said exiting end to be grasped for removal from the carton.

25. The carton of claim 24 including at least one means for creating the opening located between said top and bottom tear lines.

26. The carton of claim 25 in which said means is located at least partially in at least one of the side panels.

27. An enclosed carton for carrying a plurality of containers in a plurality of rows, including a first row, and a second row above the first row, with each container having a diameter and two ends, the carton comprising:

a. a bottom panel, top panel and foldably attached adjoining side panels;

b. a plurality of ends, at least one of which is an exiting end capable of permitting the containers to exit the carton one at a time, said exiting end having a bottom end flap that is attached by a fold line to the bottom panel, a top end flap foldably attached to the top panel, side end flaps foldably attached to each side panel and means for attaching all said flaps together to close the exiting end of carton;

c. said exiting end having a bottom tear line and a top tear line formed in each side end panel and extending thereacross for forming an opening, said bottom tear line having a height from said bottom panel that is sufficient to prevent any container in the first row from rolling out of the carton when said opening is created when the carton is on a horizontal plane, said top tear line having a height from said bottom panel that is greater than the diameter of a container to be contained in said first row of containers and at a sufficient height from said bottom panel to prevent any container in the second row from rolling out of the carton when the carton is on a horizontal plane;

d. said top and bottom tear lines extending into at least one of said side panels and said top and bottom tear lines being separable to expose each said end of a container in the second row adjacent said exiting end; and e. means for closing any end of the carton that is not the exiting end.

28. The carton of claim 27 in which the sufficient distance permits the exposed container ends in the second row adjacent said exiting end to be grasped to remove the exposed container from the carton.

29. The carton of claim 28 including means for creating the opening located at least partially in said side panel.

* * * * *